United States Patent [19]

Fehrenbach et al.

[11] Patent Number: 4,901,649

[45] Date of Patent: Feb. 20, 1990

[54] SPAN BOLSTER ASSEMBLY

[75] Inventors: Eugene T. Fehrenbach, Matteson; Joseph W. Lam, Chicago, both of Ill.

[73] Assignee: Thrall Car Manufacturing Company, Chicago Heights, Ill.

[21] Appl. No.: 278,544

[22] Filed: Dec. 1, 1988

[51] Int. Cl.[4] ..... B61F 5/00; B60P 3/40

[52] U.S. Cl. ..... 105/183; 410/45; 105/228

[58] Field of Search ..... 105/182.1, 183, 420, 105/418, 413, 416, 414, 228, 199.1, 199.2, 199.3, 199.4, 202, 208, 355, 362; 410/45

[56] References Cited

U.S. PATENT DOCUMENTS

| | | | |
|---|---|---|---|
| 3,207,086 | 9/1985 | Mowatflarssen et al. | 105/418 X |
| 3,577,933 | 5/1971 | Ferris et al. | 105/416 X |
| 4,160,420 | 7/1979 | Hackbarth et al. | 105/183 X |
| 4,161,913 | 7/1979 | Gaillaumin | 105/202 X |

OTHER PUBLICATIONS

Drawing #E-45385-5, Maxson Corp. "Span Bolster Arrg't", 04/78.

Drawing #E-904-31, Maxson Corp., "100TON Span Bolster with Cushioned Unit", 04/82.

*Primary Examiner*—Andres Kashnikow

*Assistant Examiner*—Virna Lissi Mojica

*Attorney, Agent, or Firm*—Marshall, O'Toole, Gerstein, Murray & Bicknell

[57] ABSTRACT

A span bolster, for carrying a heavy load of a railroad car body and distributing the load to two four wheel two axle railroad bogies or trucks, is fabricated from steel plate and has top and bottom cover plates, top and bottom reinforcement doubler plates, longitudinal spaced apart webs separating the cover plates, body bolsters at each end and a central truck bolster, all formed of metal plate joined together by welding with all critical welds being full penetration welds, and with the span bolster being stress relieved after fabrication.

35 Claims, 5 Drawing Sheets

FIG. 9
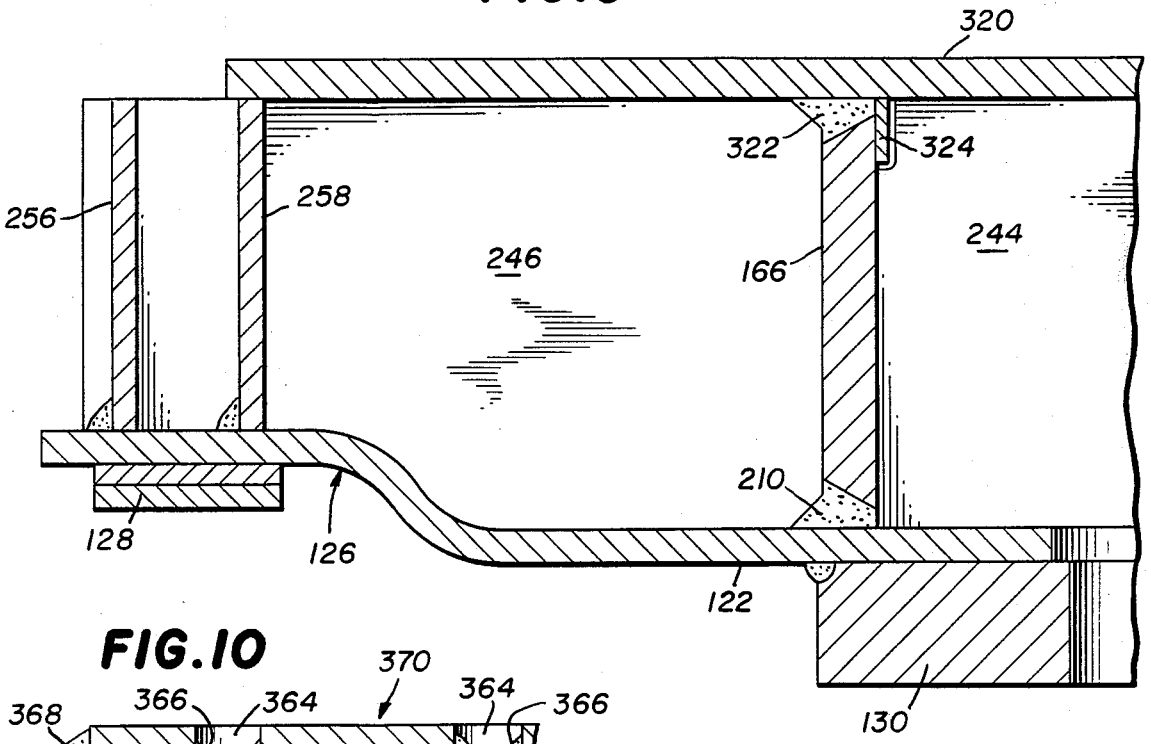
FIG. 10
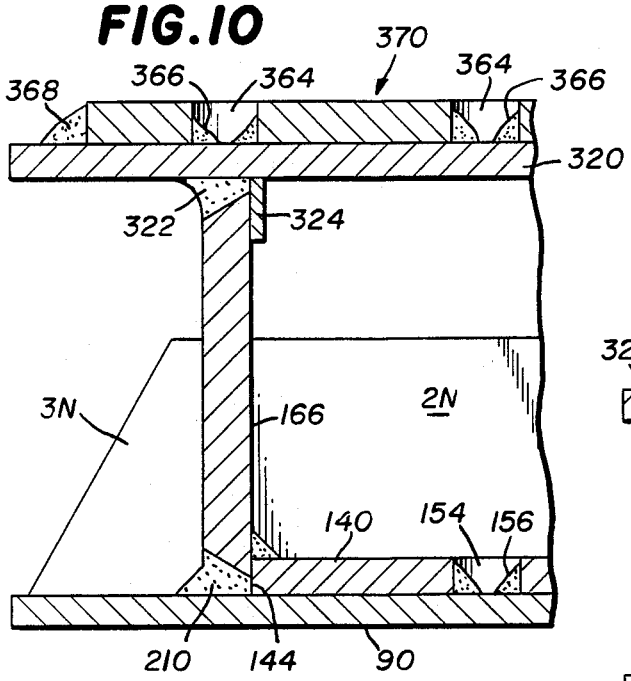
FIG. 11
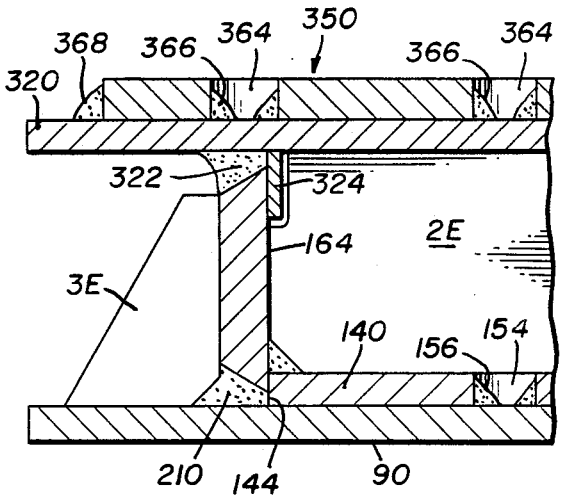
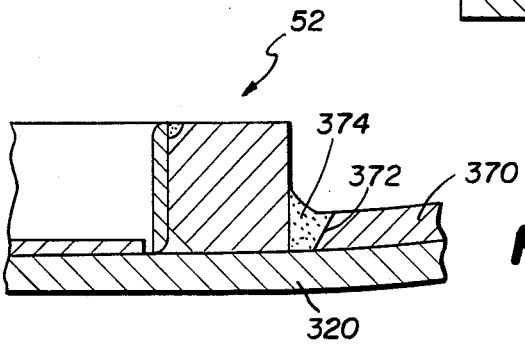
FIG. 12

SPAN BOLSTER ASSEMBLY

This invention relates to railroad cars. More particularly, this invention pertains to improvements in railroad cars capable of carrying extra heavy loads which generally require at least one, and usually two, pair of conventional four wheel bogies or trucks, each pair of which is cooperatively united by a span bolster which accepts the load and transfers it to the pair of trucks.

BACKGROUND OF THE INVENTION

The usual railroad freight cars in use in the United States have a body which is supported at each end by a conventional four wheel two axle railroad bogie or truck. While such cars are capable of carrying most cargo transported throughout the country there are some loads which are much too heavy to be transported by such cars, even with trucks of 100 ton capacity. Some such cargoes are electric generators, nuclear reactors, heavy walled pressure vessels and special equipment pertaining to national defense and space exploration.

To transport extra heavy loads of the described types special railroad cars have been developed which utilize more than two trucks per car so as to distribute the load between the trucks and over a greater area of track roadbed. One way of distributing the load is to connect a pair of railroad trucks by means of a span bolster, each end of which has a body bolster supported by a truck bolster. The top center of the span bolster has a center bowl which receives a center plate mounted on the bottom of the car body, which may be of various kinds including a flat car body. Span bolsters of the described type are shown in Hackbarth et al U.S. Pat. No. 4,160,420, FIG. 1, and Kramlinger U.S. Pat. No. 4,263,852, FIG. 1.

The only commercially available cast span bolster is made by Buckeye Steel Castings from five separate cast steel pieces which are girth seam welded together. The two end body bolsters are separate cast pieces as is the center bolster. These three pieces are joined together by a center sill casting between each end body bolster and the center bolster. Such a span bolster is costly. Also, the center plates and the center bowl are integral with the castings so they cannot be replaced when worn nor can they be repositioned for alignment adjustment after the cast pieces are welded together.

Another type of span bolster has been installed on extra heavy load carrying railroad cars by The Maxson Corporation, St. Paul, Minn. The Maxson span bolster was fabricated from steel plate weldments. However, it was not a successful design in that it occasionally failed in use.

SUMMARY OF THE INVENTION

According to the invention a fabricated span bolster is provided comprising an elongated center sill having first and second ends; a lateral first body bolster at the first end of the center sill; a lateral second body bolster at the second end of the center sill; a lateral central bolster, located between the first and second body bolsters, comprising a pair of opposing arms extending laterally outward from the center sill; the center sill and the first, second and central bolsters having a common top cover plate; a center bowl located on the top cover plate in the center of the central bolster; the center sill having a reinforcement doubler plate on top of and in contact with and joined to the top cover plate on each side of the center bowl and extending substantially to the respective first and second body bolsters; a bottom cover plate common to the center sill and the first and second bolsters; the bottom cover plate portion of the center sill being smoothly curved first downwardly and then upwardly to define a concave and convex portion when viewed from the side and having its major depth in the concave portion beneath the center bowl; a bottom doubler plate on top of and in contact with and joined to the bottom cover plate and extending for at least substantially the length of the center sill; the top and bottom cover plates being joined together through at least two longitudinal spaced apart substantially vertical and parallel web plates between the top and bottom cover plates, with the web plates being longitudinally aligned with, and extending for substantially the length of, the center sill; the first body bolster having a center plate joined to the bottom of the bottom cover plate located substantially on the lateral center between the first bolster ends; the second body bolster having a center plate joined to the bottom of the bottom cover plate located substantially on the lateral center between the bolster ends; the first bolster center plate, the second bolster center plate and the center bowl being centered along a vertical plane through an axial line longitudinal to the center sill; and the first bolster center plate bottom and the second bolster center plate bottom being in substantially the same horizontal plane.

The span bolster is characterized by a low profile compared a previous span bolster design of the Maxson Corporation, Minn. The span bolster provided by the invention can have a web depth at the center, i.e. between top and bottom cover plates, of 14.375 inches whereas the depth on the Maxson design is 18.625 inches. This difference is significant because it permits a less abrupt transition in depth from the span bolster center to the ends and thus provides a smoother load path through the bottom cover plate than does the Maxson design.

The span bolster is desirably made of steel plate, welded and then stress relieved after fabrication.

The span bolster longitudinal spaced apart web plates can be located beneath the center bowl and over the first and second bolster center plates.

The center bowl can be a separate part, fully supported by and welded to the top cover plate and also welded to the top doubler plate. Also, each of the first and second body bolster center plates can be a separate part fully supported by and welded to the bottom cover plate.

The bottom doubler plate can have longitudinal side edges and be longitudinally narrower than the bottom cover plate. The lower edge of the longitudinal vertical web plates can abut the bottom doubler plate longitudinal side edges. Also, the lower edges of the vertical web plates can be joined to the bottom cover plate and to the bottom doubler plate by a full penetration weld with the edges of the bottom doubler plate functioning as a welding back-up means. Furthermore, the opposing upper edge portions of the longitudinal vertical web plates can have a welding back-up bar and the upper edges of the vertical web plates can be joined to the top cover plate by full penetration welds.

A plurality of spaced apart lateral substantially upright web plates can be located between the longitudinal vertical web plates and between the center bowl and the ends of the center sill. Many or all of the lateral web plates can be positioned substantially normal or vertical to a line tangent to the curved concave portion of the bottom cover plate where each lateral web plate is located.

The center bowl can have a circular substantially vertical side wall and each of the top doubler plates can have an inner end welded to the center bowl side wall.

Each of the longitudinal vertical web plates can be substantially thinner, particularly in the center sill concave portion, than in the outer portions of the center sill and in the first and second body bolsters.

Each of the longitudinal vertical web plates can have a middle portion in the center sill concave portion made of relatively thin plate terminating in first and second ends; a relatively thick plate forming part of the vertical web can abut the thin plate first end thereby forming a joint and extending outwardly therefrom, a weld back-up bar can be behind the joint, and a full penetration weld can join the ends of the plates together; and a relatively thick plate forming part of the vertical web can abut the thin plate second end thereby forming a joint and extending outwardly therefrom, a weld back-up bar can be behind the joint, and a full penetration weld can join the ends of the plates together.

The portion of the bottom cover plate beneath the first body bolster can have upwardly stepped opposing arms or ends which, if desired, can terminate beyond the top cover plate. Each of the stepped ends can have a body bolster side bearing support block or plate mounted on the bottom of each upwardly stepped end.

A pair of lateral spaced apart substantially vertical and parallel first body bolster web plates can be located between and join together the portions of the top and bottom cover plates of the first body bolster. A pair of vertical spaced apart reinforcing plates can be located between and be joined to the lateral web plates at each upwardly stepped end above the side bearing support block or plate.

The portion of the bottom cover plate beneath the second body bolster can have upwardly stepped opposing arms or ends which terminate beyond the top cover plate. Each of the upwardly stepped ends can have a body bolster side bearing plate mounted on the bottom of each stepped end.

A pair of lateral spaced apart substantially vertical and parallel first body bolster web plates can be located between and join together the portions of the top and bottom cover plates of the first body bolster. A pair of vertical spaced apart reinforcing plates can be located between and be joined to the lateral web plates at each stepped end above the side bearing support block or plate.

The center sill can have a plurality of spaced apart substantially upright gusset plates located on the outside of the center sill longitudinal vertical web plates. Many or all of the gusset plates can be positioned substantially normal or vertical to a line tangent to the curved concave and convex portion of the bottom cover plate where each gusset plate is located. Also, a plurality or all of the gusset plates can be aligned with the lateral web plates that are inside the longitudinal vertical webs.

The central bolster can have a bottom lateral sole plate beneath and joined to the center sill bottom cover plate, and be spaced below the center sill web plates as well as below the central bolster cover plate arms; and a pair of spaced apart substantially vertical and parallel central bolster web plates can be located between and join together the center sill and central bolster top cover plate, the sole plate and the center sill bottom cover plate and, desirably, the bottom doubler plate. The sole plate can be one piece of plate and the outer ends thereof can slope upwardly. A vertical reinforcing plate can be located between and be joined to the central bolster web plates near each end of the central bolster. Also, a vertical gusset plate can be located on the outside of each central bolster web plate near each arm or end of the central bolster. Additionally, a vertical stiffener gusset plate can be located on the outside of the central bolster web plates where the sole plate slopes or bends upwardly. These gusset plates extend from the sole plate to the top cover plate.

A side bearing support spacer block can be located on the top cover plate at the end of each central bolster arm.

The span bolster provided by the invention has a low profile and is designed to be used with trucks having 4.25 inches of travel (D-7) springs. Previous span bolsters could not be used with trucks having such springs. The softer springs will alleviate or soften track impact loads transmitted by the truck wheels into the span bolster.

Both the top and bottom doubler plates are sloped or scalloped at the ends furthest from the central transverse bolster. This is done to lessen the concentration of stress at the juncture between the doubler plate outer ends and the adjacent center sill cover plate as well as to increase the fatigue life of the weld joint which joins the doubler plate to the adjacent cover plate (FIGS. 5, 6 and 14).

All weld joints are to be prequalified AWS joints. Also, groove welds are not to be tied to fillet welds at highly stressed junctures such as tee joints, and web plates joined to top and bottom cover plates.

BRIEF DESCRIPTION OF THE DRAWINGS

FIG. 9 is a sectional view taken along the line 9—9 of FIG. 3;

FIG. 10 is a sectional view taken along the line 10—10 of FIG. 2;

FIG. 11 is a sectional view taken along the line 11—11 of FIG. 2;

FIG 12 is a sectional view taken along the line 12—12 or FIG. 3;

DETAILED DESCRIPTION OF THE DRAWINGS

To the extent it is reasonable and practical the same or similar elements appearing in the various views of the drawings will be identified by the same numbers.

Figure 1:
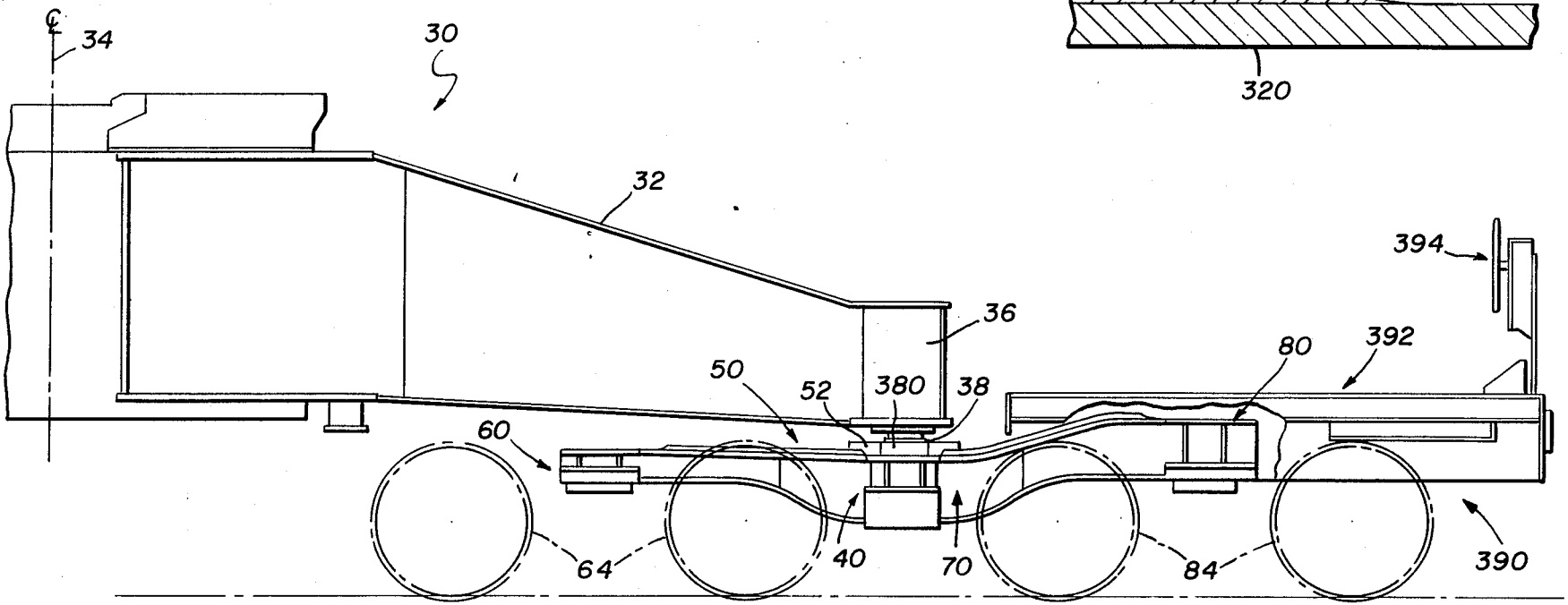
FIG. 1 is a side elevational view of one end of a railroad car body for transporting very heavy loads which is supported at each end by a span bolster provided by the invention.

With reference to FIG. 1 the railroad car 30 has a car body 32 longitudinally symmetrical in each direction from its vertical center line 34. Car body 32 has two identical ends, but only one end 36 is shown. The car end 36 constitutes a car body bolster which has a bearing plate 38 located on the bottom along the car longitudinal center line. The bearing plate 38 is mounted in center bowl 52 in the center of the lateral central bolster 40 (which may also be called a truck bolster) of span bolster 50. The central bolster 40 has a pair of opposing arms extending laterally outward from a center sill 70.

The span bolster 50 has a lateral first or inboard body bolster 60 at the first end of the span bolster longitudinal center sill 70 and a lateral second or outboard body bolster 80 at the second end of the span bolster 50 longitudinal center sill 70. The first body bolster is supported on a four wheel two axle railway truck or bogie 64 of conventional construction but built to carry a heavy load, such as 100 tons. Similarly, the second body bolster 80 is supported on a railway truck or bogie 84 essentially like truck 64. Both of the first and second body bolsters 60,80 have a pair of opposing arms extending laterally outward from the center sill 70.

Figure 2:
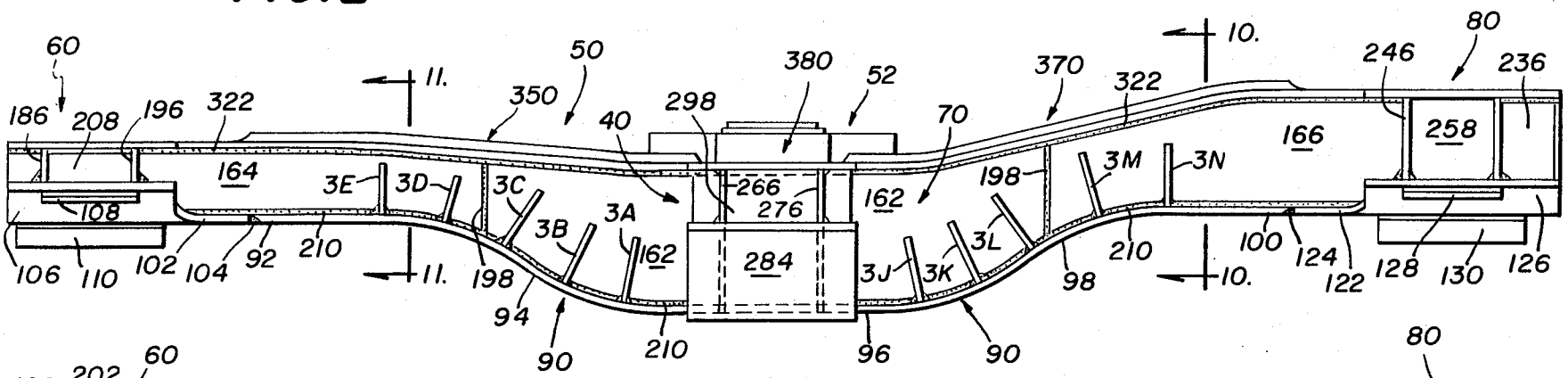
FIG. 2 is a side elevational view of the span bolster shown on the car illustrated in FIG. 1.
Figure 3:
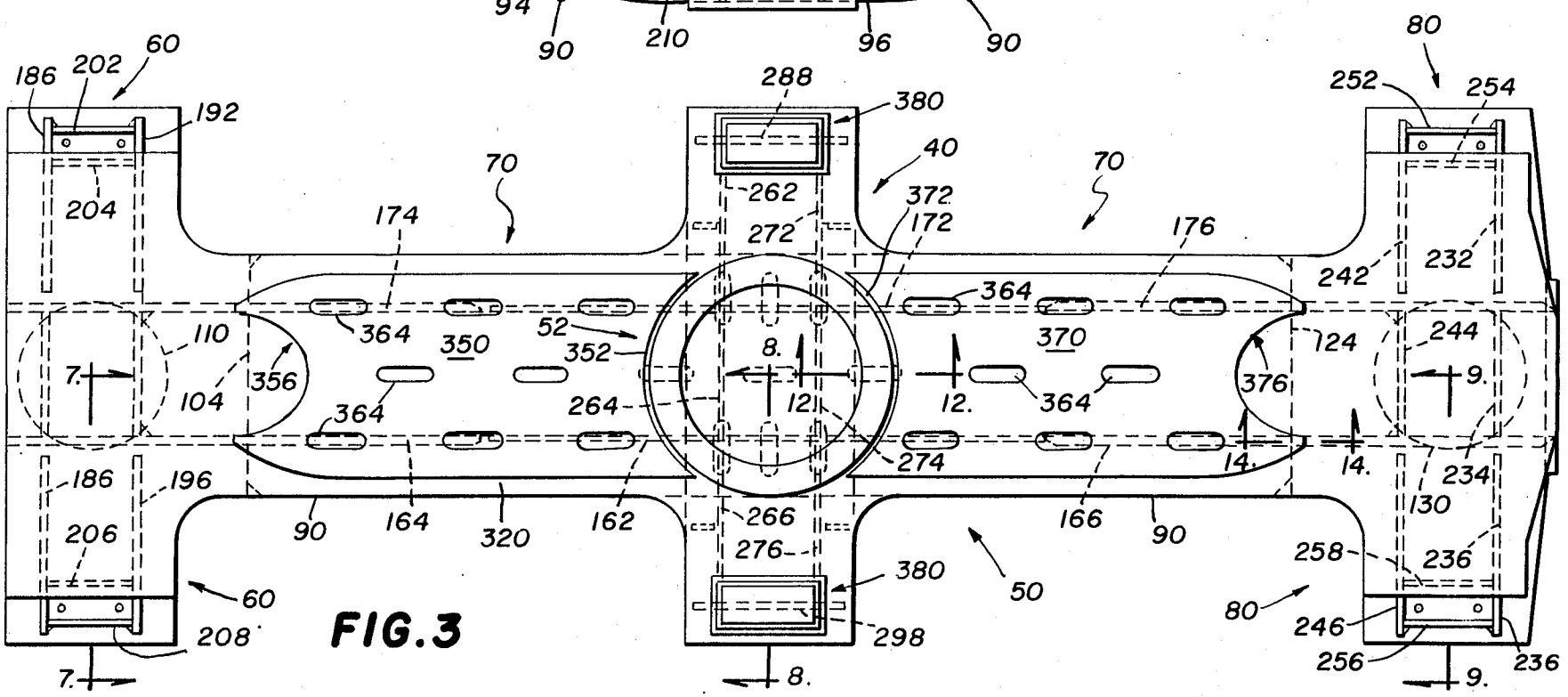
FIG. 3 is a plan view of the span bolster shown in FIG. 2.

The span bolster 50 center sill 70 includes a bottom cover plate 90 which extends for the longitudinal length of the span bolster (FIGS. 2 and 3). The bottom cover plate 90 has a flat horizontal portion 92, an S-curved portion 94, a central flat portion 96, an S-curved portion 98 and another flat horizontal portion 100. The described bottom cover plate when viewed in side elevational thus has a concave and convex portion having its major depth in the concave portion beneath the center bowl. The flat end portions 92 and 100 lie essentially in the same plane so that when the span bolster is mounted on the identical trucks 64,84 the span bolster will be level.

Figure 7:
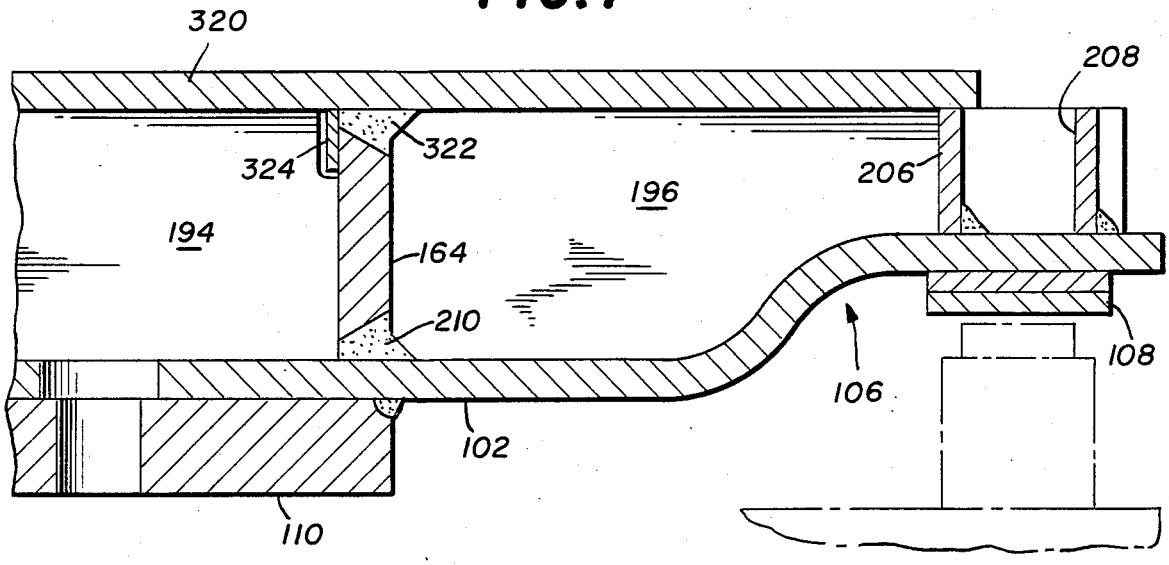
FIG. 7 is a sectional view taken along the line 7—7 of FIG. 3.

While the entire bottom cover plate 90 can be made of a single integral steel plate it is preferable to use a separate stub T-plate 102 for the bottom portion of the first body bolster 60 and to join it to the end of the adjoining portion of the bottom cover plate by a full penetration weld 104 (FIGS. 2 and 7). The lateral outer ends 106 of the stub T-plate 102 are stepped-up to provide space for first body bolster side bearing plates 108. Circular center plate 110 is mounted on the bottom surface of first body bolster 60 along the longitudinal center line of the span bolster 50. The center plate 110 rests in the truck bolster center bowl of truck 64.

That portion of the bottom cover plate 90 which constitutes a portion of the second or outboard body bolster 80 is also preferably made of a separate stub T-plate 122 which is joined to the end of the adjoining portion of the bottom cover plate by a full penetration weld 124 (FIGS. 2 and 9). The lateral outer arms or ends 126 of the stub T-plate 122 are stepped-up to provide space for second body bolster side bearing plates 128. Circular center plate 130 is mounted on the bottom surface of second or outboard body bolster 80 along the longitudinal center line of the span bolster 50. The center plate 130 rests in the truck bolster center bowl of truck 84.

Figure 5:
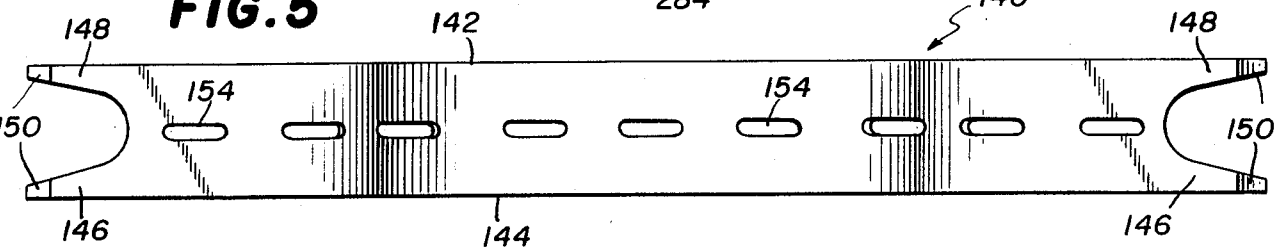
FIG. 5 is a plan view of the bottom doubler plate.
Figure 6:
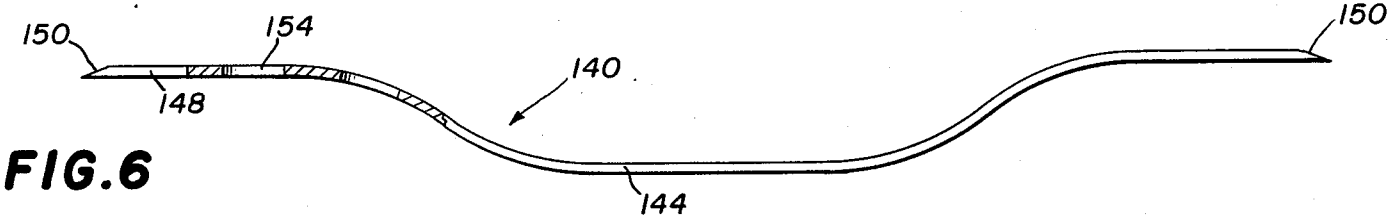
FIG. 6 is a side elevational view of the bottom doubler plate shown in FIG. 5.

A bottom doubler plate 140 (FIGS. 4 to 6) nests on and with the top surface of bottom cover plate 90. The bottom doubler plate 140 has opposing side edges 142,144 which lie in spaced apart vertical planes. The longitudinal ends of the doubler plate 140 are identical and each end terminates in a fork-like structure formed by cutting out a parabolic shaped piece of the plate. The two limbs 146,148 of the fork end in tapered downwardly sloped surfaces 150 which have line ends essentially like the structure shown in FIG. 14.

Figure 8:
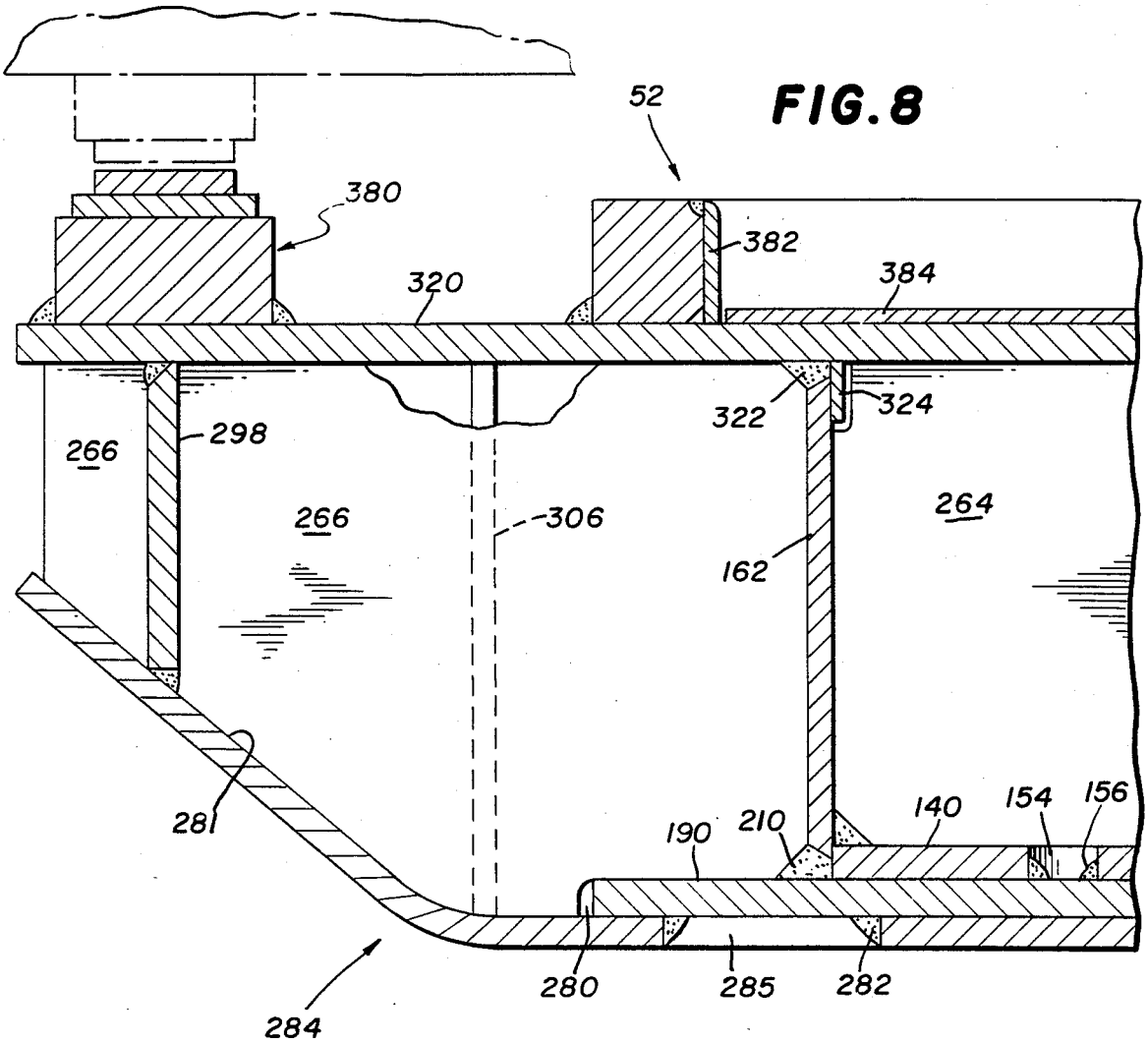
FIG. 8 is a sectional view taken along the line 8—8 of FIG. 3.

The lateral width of bottom doubler plate 140 is about one-half the lateral width of that portion of the bottom cover plate 90 between the first and second body bolsters 60,80. A series of nine spaced apart longitudinal slots 154 are located along the longitudinal center line of the bottom doubler plate 140. The slots 154 extend through the doubler plate 140 and provide means to weld the doubler plate to the bottom cover plate by fillet welds 156 (FIGS. 8, 10 and 11).

Figure 4:
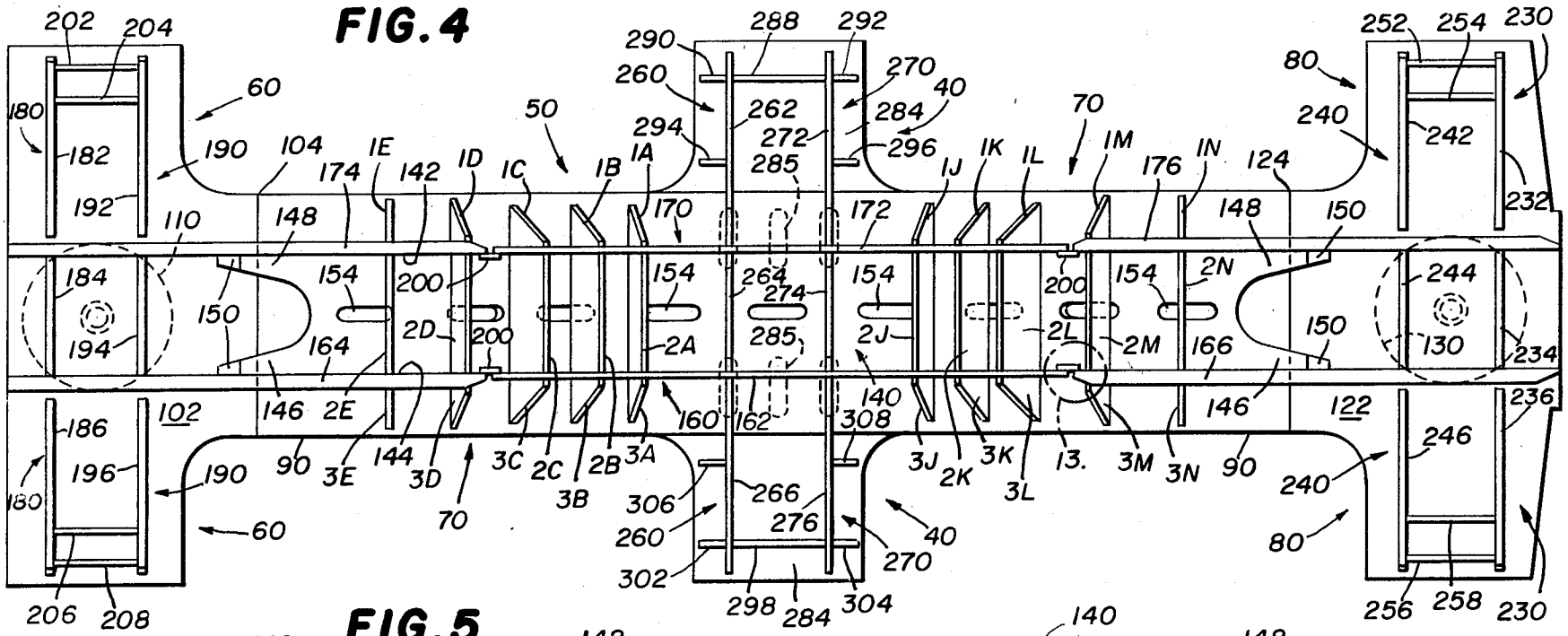
FIG. 4 is a plan view of the span bolster shown in FIG. 3 with the top cover plate and the top doubler plate removed.

Also forming part of the span bolster 50 center sill are two spaced apart vertical identical web plates 160,170. The lower edges of the webs follow the contour of the bottom cover plate 90 and nest with it. The lower edge portion of web plate 160 contacts the edge 144 of the bottom doubler plate 140 and the lower edge portion of web plate 170 contacts the edge 142 of the bottom doubler plate 140 (FIGS. 4, 10 and 11).

Figure 13:
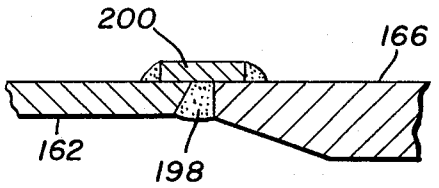
FIG. 13 is an enlarged view of that portion of FIG. 4 surrounded by a circle and numbered 13.

The central portion of web plate 160 is made of thinner plate 162 while the outer portions of that web plate are made of thicker plates 164,166. The vertical ends of the thinner plate 162 are joined to the adjacent vertical ends of the thicker plates 164,166 by full penetration welds 198 with the use of a weld back-up bar 200 (FIGS. 4 and 13). Similarly, the central portion of web plate 170 is made of thinner plate 172 while the outer portions of that web plate are made of thicker plates 174,176. The vertical ends of the thinner plate 172 are joined too the adjacent vertical ends of the thicker plates 174,176 by full penetration welds 198 with the use of a weld back-up bar 200.

Full penetration welds 210 join the lower edge portions of the web plates 160,170 to the bottom cover plate 90 and to the respective side edges 144,142 of the bottom doubler plate 140 where it is present alongside those web plates (FIGS. 2, 8, 10 and 11). Welding beyond the extent of doubler plate 140 is carried out with temporary backing such as copper or ceramic backing tape.

A plurality of spaced apart lateral substantially upright web plates 2A, 2B, 2C, 2D and 2E are positioned between the web plates 160,170 and they are located inboard between the central bolster 40 and the first body bolster 60. These lateral web plates are arranged to be substantially normal or perpendicular to a line tangent to the bottom doubler plate where the web plate is located. The lateral web plates 2A, 2B, 2C, 2D and 2E are welded along their side edges and bottom edges to the side webs 160,170 and to the top of bottom doubler plate 90.

Gussets 1A, 1B, 1C, 1D and 1E are welded to the outer surface of web plate 170 and to the upper surface of bottom cover plate 90. Similarly, the gussets 3A, 3B, 3C, 3D and 3E are welded to the outer surface of web plate 160 and to the upper surface of bottom cover plate 90. Gussets 1A, 3A are planarly aligned with lateral web plate 2A; gussets 1B, 3B are aligned with lateral web plate 2B; gussets 1C, 3C are aligned with lateral web plate 2C; gussets 1D, 3D are aligned with lateral web plate 2D; and gussets 1E, 3E are aligned with lateral web plate 2E.

A plurality of spaced apart lateral substantially upright web plates 2J, 2K, 2L, 2M, 2N are positioned between the web plates 160,170 and they are located outboard between the second body bolster 80. These lateral web plates are arranged to be substantially normal or perpendicular to a line tangent to the bottom doubler plate where the web plate is located. The lateral web plates 2J, 2K, 2L, 2M, 2N are welded along their side edges and bottom edges to the side webs 160,170 and to the top of bottom doubler plate 90.

Gussets 1J, 1K, 1L, 1M, 1N are welded to the outer surface of web plate 170 and to the upper surface of bottom cover plate 90. Similarly, the gussets 3J, 3K, 3L, 3M, 3N are welded to the outer surface of web plate 160 and to the upper surface of bottom cover plate 90. Gussets 1J, 3J are planarly aligned with lateral web plate 2J; gussets 1K, 3K are aligned with lateral web plate 2K; gussets 1L, 3L are aligned with lateral web plate 2L; gussets 1M, 3M are aligned with lateral web plate 2M; and gussets 1N, 3N are aligned with lateral web plate 2N.

The first or inboard body bolster 60 includes a pair of spaced apart identical lateral vertical parallel web plates 180,190 located above the center plate 110. The lateral web plate 180 includes the three plate sections 182,184,186 while the lateral web plate 190 includes the three plate sections 192,194,196 (FIGS. 4 and 7). The plate sections 182,192 are identical and the inner end of each plate section is welded to plate 174. The two middle plate sections 184,194 are identical and their ends are welded to longitudinal plates 164,174. Plate sections 186,196 are also identical and the inner end of each plate section is welded to plate 164. Additionally, the bottom edge of each plate section 182,184,186,192,194,196 is welded to the top of plate 102 although all such welds are not shown in the drawings so as to maintain clarity of illustration by the drawings.

A pair of vertical spaced apart reinforcing plates 202,204 is located between and joined to the plates 182,192 above side bearing support blocks or plates 108. The bottom edges of the reinforcing plates 202,204 are welded to the top of plate 102 and the ends of the reinforcing plates are welded respectively to plate sections 182,192. Similarly, a pair of vertical spaced apart parallel reinforcing plates 206,208 is located between and joined to the plates 186,196 above side bearing support blocks or plates 108. The bottom edges of the reinforcing plates 206,208 are welded to the top of plate 102 and the ends of the reinforcing plates are welded respectively to plate sections 186,196.

The second or outboard body bolster 80 includes a pair of spaced apart identical lateral vertical parallel web plates 230,240 located above the center plate 130. The lateral web plate 230 includes the three plate sections 232,234,236 while the lateral web plate 240 includes the three plate sections 242,244,246 (FIGS. 4 and 9). The plate sections 232,242 are identical and the inner end of each plate section is welded to plate 176. The two middle plate sections 234,244 are identical and their ends are welded to longitudinal plates 166,176. Plate sections 236,246 are also identical and the inner end of each plate section is welded to plate 166. Additionally, the bottom edge of each plate section 232,234,236,242,244,246 is welded to the top of plate 122 although all such welds are not shown so as to maintain clarity of illustration by the drawings.

A pair of vertical spaced apart reinforcing plates 252,254 is located between and are joined to the plate sections 232,242 above the side bearing plates 128. The bottom edges of the reinforcing plates 252,254 are welded to the top of plate 122 and the ends of the reinforcing plates are welded respectively to plate sections 232,242. Similarly, a pair of vertical spaced apart parallel reinforcing plates 256,258 is located between and joined to the plate sections 236,246 above side bearing plates 128. The bottom edges of the reinforcing plates 256,258 are welded to the top of plate 122 and the ends of the reinforcing plates are welded respectively to plate sections 236,246.

The lateral central or truck bolster 40 includes a pair of spaced apart identical vertical parallel web plates 260,270 located below the center bowl 52. The lateral web plate 260 includes the three plate sections 262,264,266 while the lateral web plate 270 includes the three plate sections 272,274,276 (FIGS. 4 and 8). The plate sections 262,272 are identical and the inner end of each plate section is welded to plate 172. The two middle plate sections 264,274 are also identical and their ends are welded to longitudinal plates 162,172. Plate sections 266,276 are also identical and the inner end of each plate section is welded to plate 162.

The bottom edges of plate sections 264,274 abut bottom doubler plate 140 and are welded to it. Also, the vertical side edges of plate sections 264,274 are welded to plates 162,172.

Each of the inward bottom edges of plate sections 262,272,266,276 has a cut-out space 280 into which the bottom cover plate 90 extends. The height of the cut-out space equals the thickness of the bottom cover plate. Additionally, the outer bottom edge 281 of each plate section 262,272,266,276 is sloped outwardly and upwardly at an angle of about 45° (FIG. 8).

A bottom lateral sole plate 284 is located beneath and is joined to the center sill bottom cover plate 90 and to the bottom edge of plate sections 262,272,266,276. Slots 285 in the central part of sole plate 284 provide means for welds 282 to join the sole plate 284 to the bottom cover plate 90 (FIGS. 4 and 8).

A vertical reinforcing plate 288 is located near and between the outer ends of plate sections 262,272. In addition, vertical gussets 290,292 are placed outside of plate sections 262,272 but in alignment with reinforcing plate 288. The gussets 290,292 and plate 288 are welded to sole plate 284 and to plate sections 262,272. Two additional vertical gussets 294,296 are positioned on the outside of plate sections 262,272 for further reinforcement.

A vertical reinforcing plate 298 is located near and between the outer ends of plate sections 266,276. In addition, vertical gussets 302,304 are placed outside of plate sections 266,276 but in alignment with reinforcing plate 298. The gussets 302,304 and plate 298 are welded to sole plate 284 and to plate sections 266,276. Two additional gussets 306,308 are positioned on the outside of plate sections 266,276 for further reinforcement (FIGS. 4 and 8).

The span bolster 50 also includes a top cover plate 320, desirably a one piece structure, which constitutes a common top cover plate for the center sill 70 and the first 60, second 80 and central 40 bolsters. The top cover plate 320 is joined by welding to the top edges of plates 172,174,176,162,164 and 166 of the center sill 70; lateral and reinforcing plates 182,192,184,186,196, 202,204,206,208 of the first body bolster 60, lateral and reinforcing plates 232,242,234,236,246,252,254,256,258 of the second body bolster 80; and lateral and reinforcing plates 262,272,266,276,288 and 298 of the central bolster 40. The gussets 290,292,294,296,302,304,306,308 are also joined by welding to the top cover plate 320. The web plates 2A, 2B, 2C, 2D, 2E, 2J, 2K, 2L, 2M, 2N, as well as the gussets in alignment with these web plates, are not joined to the top cover plate 320.

Side bearing reinforcement plates 202,208 at body bolster 60 and 252,258 at body bolster 80 are welded to the top cover plate 320.

The top edges of the longitudinal vertical plates 172,174,176,162,164 and 166 are joined to the top cover plate 320 by full penetration welds 322 using a horizontal back-up bar 324.

The center sill 70 has a reinforcement top doubler plate in two sections 350,370 on top of and in contact with and joined to the top cover plate 320 on each side of the center bowl 52 and extending substantially to the first and second body bolsters 60,80. The top doubler plate sections 350,370 are both curved but section 370 is more arced than section 350. However, the two top doubler plate sections 350,370 have the same width, but they are narrower than the top cover plate 320. The doubler plate sections are approximately the same length.

The ends of the top doubler plate sections 350,370 are cut-out 352,372 in the shape of a segment of a circle having a diameter equal to the outer diameter of center bowl 52 so that the doubler plate sections can abut the center bowl and be welded 374 both to the top cover plate 320 and to the bowl (FIGS. 3 and 12).

Figure 14:
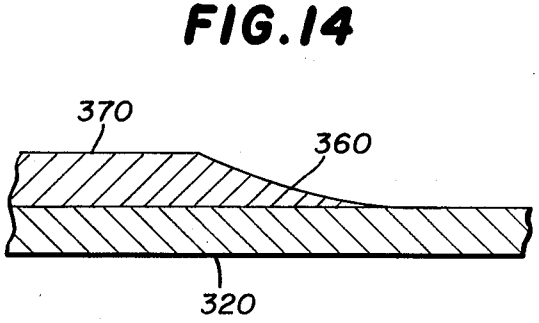
FIG. 14 is an enlarged view of the ends of the bottom and top doubler plates.

The outer ends 356,376 of the top doubler plate sections 350,370 are cut-out to form a fork and the top surfaces of the ends of the branches are tapered down to a line edge 360 (FIGS. 2, 3 and 14).

The top doubler plate sections 350,370 each have three spaced apart longitudinal rows of slots 364 in which welds 366 are deposited to join the doubler plate sections to the top cover plate 320 (FIGS. 10 and 11).

The top doubler plate sections 350,370 are further joined to the top cover plate 320 by peripheral welds 368 (FIGS. 10 and 11).

Each of the outer ends of central bolster 40 is provided with a side bearing spacer block 380 mounted on the cover plate 320 above reinforcement plates 288,298.

The center bowl 52 is provided with a circular vertical liner ring 382 and a bottom circular plate 384, both of which can be replaced when they become too worn. Furthermore, the entire center bowl 52 can be cut out and be replaced by a new bowl if desired.

The center sill portion of the span bolster which extends through the second body bolster 80 is positioned at an elevation above the railroad tracks suitable for receiving conventional railroad draft gear 390 on which a platform 392 can be mounted to operate hand brake 394.

The foregoing detailed description has been given for clearness of understanding only, and no unnecessary limitations should be understood therefrom, as modifications will be obvious to those skilled in the art.

What is claimed is:

1. A fabricated span bolster comprising:

an elongated center sill having first and second ends;

a lateral first body bolster at the first end of the center sill;

a lateral second body bolster at the second end of the center sill;

a lateral central bolster, located between the first and second body bolsters, comprising a pair of opposing arms extending laterally outward from the center sill;

the center sill and the first, second and central bolsters having a common top cover plate;

a center bowl located on the top cover plate in the center of the central bolster;

the center sill having a reinforcement doubler plate on top of and in contact with and joined to the top cover plate on each side of the center bowl and extending substantially to the respective first and second body bolsters;

a bottom cover plate common to the center sill and the first and second bolsters;

the bottom cover plate portion of the center sill being laterally smoothly curved first downwardly and then upwardly to define a concave and convex portion having its major depth beneath the center bowl;

a bottom doubler plate on top of and in contact with and joined to the bottom cover plate and extending for at least substantially the length of the center sill;

the top and bottom cover plates being joined together through at least two longitudinal spaced apart substantially vertical and parallel web plates between the top and bottom cover plates, with the web plates being longitudinally aligned with, and extending for substantially the length of, the center sill;

the first body bolster having a center plate joined to the bottom of the bottom cover plate located on the center between the bolster ends;

the second body bolster having a center plate joined to the bottom of the bottom cover plate located on the center between the bolster ends;

the first bolster center plate, the second bolster center plate and the center bowl being centered along a vertical plane through an axial line longitudinal to the center sill; and the first bolster center plate bottom and the second bolster center plate bottom being in substantially the same horizontal plane.

2. A fabricated span bolster according to claim 1 in which the longitudinal spaced apart web plates are located beneath the center bowl and over the first bolster center plate and over the second bolster center plate.

3. A fabricated span bolster according to claim 1 or 2 made of steel and welded and stress relieved after fabrication.

4. A fabricated span bolster according to claim 1 in which the center bowl is a separate part fully supported by the top cover plate and it is welded to the top cover plate and to the top doubler plate.

5. A fabricated span bolster according to claim 1 in which each of the first and second body bolster center plates is a separate part fully supported by the bottom cover plate and welded to the bottom cover plate.

6. A fabricated span bolster according to claim 1 in which the bottom doubler plate has longitudinal side edges and is longitudinally narrower than the bottom cover plate.

7. A fabricated span bolster according to claim 6 in which the lower edge of the longitudinal vertical web plates abut the bottom doubler plate longitudinal side edges.

8. A fabricated span bolster according to claim 7 in which the lower edges of the vertical web plates are joined to the bottom cover plate by a full penetration weld with the edges of the bottom doubler plate functioning as a welding back-up means.

9. A fabricated span bolster according to claim 7 in which the opposing upper edge portions of the longitudinal vertical web plates have a welding back-up bar and the upper edges of the vertical web plates are joined to the top cover plate by full penetration welds.

10. A fabricated span bolster according to claim 1 in which a plurality of spaced apart lateral substantially upright web plates are located between the longitudinal vertical web plates between the center bowl and the ends of the center sill.

11. A fabricated span bolster according to claim 10 in which many of the lateral web plates are positioned substantially normal or vertical to a line tangent to the curved concave and convex portion of the bottom cover plate where each lateral web plate is located.

12. A fabricated span bolster according to claim 1 in which the center bowl has a circular substantially vertical side wall and each of the top doubler plates has an inner end welded to the center bowl side wall.

13. A fabricated span bolster according to claim 1 in which each of the longitudinal vertical web plates is substantially thinner in the center sill concave portion than in the outer portion of the center sill and in the first and second body bolsters.

14. A fabricated span bolster according to claim 1 in which:

each of the longitudinal vertical web plates comprises a middle portion in the center sill concave portion made of relatively thin plate terminating in first and second ends;

a relatively thick plate forming part of the vertical web abutting the thin plate first end thereby forming a joint and extending outwardly therefrom, a weld back-up bar behind the joint, and a full penetration weld in the joint connecting the plates together; and a relatively thick plate forming part of the vertical web abutting the thin plate second end thereby forming a joint and extending outwardly therefrom, a weld back-up bar behind the joint, and a full penetration weld in the joint connecting the plates together.

15. A fabricated span bolster according to claim 1 in which the portion of the bottom cover plate beneath the first body bolster has upwardly stepped opposing ends which terminate beyond the top cover plate.

16. A fabricated span bolster according to claim 15 in which each of the stepped ends has a body bolster side bearing spacer block mounted on the bottom of each stepped end.

17. A fabricated span bolster according to claim 1 in which a pair of lateral spaced apart substantially vertical and parallel first body bolster web plates are located between and join together the portions of the top and bottom cover plates of the first body bolster.

18. A fabricated span bolster according to claim 17 in which the portion of the bottom cover plate beneath the first body bolster has upwardly stepped opposing ends which terminate beyond the top cover plate.

19. A fabricated span bolster according to claim 18 in which each of the stepped ends has a body bolster side bearing plate mounted on the bottom of each stepped end and the lateral web plates extend to about the end of the stepped ends.

20. A fabricated span bolster according to claim 19 in which a pair of vertical spaced apart reinforcing plates is located between and is joined to the lateral web plates at each stepped end above the side bearing plate.

21. A fabricated span bolster according to claim 1 in which the portion of the bottom cover plate beneath the second body bolster has upwardly stepped opposing ends which terminate beyond the top cover plate.

22. A fabricated span bolster according to claim 21 in which each of the stepped ends has a body bolster side bearing spacer block mounted on the bottom of each stepped end.

23. A fabricated span bolster according to claim 1 in which a pair of lateral spaced apart substantially vertical and parallel second body bolster web plates are located between and join together the portions of the top and bottom cover plates of the second body bolster.

24. A fabricated span bolster according to claim 23 in which the portion of the bottom cover plate beneath the second body bolster has upwardly stepped opposing ends which terminate beyond the top cover plate.

25. A fabricated span bolster according to claim 24 in which each of the stepped ends has a body bolster side bearing plate mounted on the bottom of each stepped end and the lateral web plates extend to about the end of the stepped ends.

26. A fabricated span bolster according to claim 25 in which a pair of vertical spaced apart reinforcing plates is located between and is joined to the lateral web plates at each stepped end above the side bearing plate.

27. A fabricated span bolster according to claim 1 in which the center sill has a plurality of spaced apart substantially upright gusset plates are located on the outside of the longitudinal vertical web plates.

28. A fabricated span bolster according to claim 10 in which the center sill has a plurality of spaced apart substantially upright gusset plates are located on the outside of the longitudinal vertical web plates.

29. A fabricated span bolster according to claim 28 in which many of the gusset plates are positioned substantially normal or vertical to a line tangent to the curved concave and convex portion of the bottom cover plate where each gusset plate is located.

30. A fabricated span bolster according to claim 29 in which a plurality of the gusset plates is aligned with lateral web plates.

31. A fabricated span bolster according to claim 1 in which:

the central bolster has a bottom lateral sole plate beneath and joined to the center sill bottom cover plate and spaced below the central bolster cover plate arms and center bowl; and a pair of longitudinal spaced apart substantially vertical and parallel central bolster web plates is located between and join together the center sill and central bolster cover plate, the sole plate and the center sill bottom cover plate.

32. A fabricated span bolster according to claim 31 in which the sole plate is one piece.

33. A fabricated span bolster according to claim 31 in which a vertical reinforcing plate is located between and is joined to the central bolster web plates near each end of the central bolster.

34. A fabricated span bolster according to claim 33 in which a vertical gusset plate is located on the outside of each central bolster web plate near each end of the central bolster.

35. A fabricated span bolster according to claim 31 in which a side bearing spacer block is located on the cover plate top at the end of each central bolster arm.

* * * * *

UNITED STATES PATENT AND TRADEMARK OFFICE

CERTIFICATE OF CORRECTION

PATENT NO. : 4,901,649

DATED : February 20, 1990

INVENTOR(S) : EUGENE T. FEHRENBACH ET AL

It is certified that error appears in the above-identified patent and that said Letters Patent is hereby corrected as shown below:

On the title page, under "U.S. Patent Documents" insert -- 4,263,852 4/1981 Kramlinger 105/199C --; column 2, line 31, after "compared" insert -- to --; column 6, line 9, change "line" to -- tine -- and in line 38, change "too" to -- to --; column 12, line 32, delete "are" and in line 35, delete "are".

Signed and Sealed this

Twenty-second Day of January, 1991

*Attest:*

HARRY F. MANBECK, JR.

*Attesting Officer*

*Commissioner of Patents and Trademarks*